US012209793B2

(12) United States Patent
Woodling et al.

(10) Patent No.: US 12,209,793 B2
(45) Date of Patent: Jan. 28, 2025

(54) METHOD AND APPARATUS FOR ROTATING A POCKET RECESS OF A FREEZER DOOR

(71) Applicant: Midea Group Co., Ltd., Foshan (CN)

(72) Inventors: Pierce R. Woodling, Louisville, KY (US); Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 214 days.

(21) Appl. No.: 18/068,379

(22) Filed: Dec. 19, 2022

(65) Prior Publication Data

US 2024/0200852 A1 Jun. 20, 2024

(51) Int. Cl.
*F25D 23/02* (2006.01)

(52) U.S. Cl.
CPC ..... *F25D 23/028* (2013.01)

(58) Field of Classification Search
CPC ..... F25D 23/028; F25D 23/02
See application file for complete search history.

(56) References Cited

U.S. PATENT DOCUMENTS

| | | | | |
|---|---|---|---|---|
| 344,521 A | | 6/1886 | Culver | |
| 1,091,393 A | | 3/1914 | Schulde | |
| 1,533,831 A | | 4/1925 | Colchin | |
| 1,782,523 A | * | 11/1930 | Warren | A47F 3/0482 312/317.2 |
| 2,015,775 A | | 10/1935 | Manfred | |
| 2,460,681 A | | 2/1949 | Davis | |
| 3,322,480 A | | 5/1967 | Barnstead | |
| 3,354,878 A | | 11/1967 | Balls | |
| 3,393,950 A | | 7/1968 | Dutcher | |
| 3,529,881 A | | 9/1970 | Kaldenberg | |
| 3,738,727 A | | 6/1973 | Race | |
| 3,912,350 A | | 10/1975 | Gurubatham | |
| 4,092,973 A | | 6/1978 | Bernazzani | |
| 4,494,784 A | | 1/1985 | Haynes | |
| 4,624,511 A | | 11/1986 | Oehme | |
| 4,687,262 A | | 8/1987 | St Louis | |
| 4,779,941 A | | 10/1988 | Jessop | |
| 4,836,624 A | | 6/1989 | Schwickrath | |
| 4,848,312 A | | 7/1989 | Roy | |

(Continued)

FOREIGN PATENT DOCUMENTS

| | | |
|---|---|---|
| CN | 102661082 A | 9/2012 |
| CN | 102269508 B | 5/2013 |

(Continued)

OTHER PUBLICATIONS

Tran, Hanh Van, United States Patent and Trademark Office, Notice of Allowance issued in U.S. Appl. No. 17/825,768, 22 pages, dated Mar. 13, 2024.

(Continued)

*Primary Examiner* — Emmanuel E Duke
(74) *Attorney, Agent, or Firm* — Gray Ice Higdon

(57) ABSTRACT

An appliance having at least a freezer compartment. The appliance may include a at least one freezer door accessing the freezer compartment. The freezer door may include one or more pocket recesses. The freezer door may include one or more articulating feet positionable between a stowed position and a deployed position. The appliance may include one or more freezer racks.

21 Claims, 10 Drawing Sheets

(56) References Cited

U.S. PATENT DOCUMENTS

| | | | |
|---|---|---|---|
| 5,937,481 | A | 8/1999 | Faringosi |
| 6,263,867 | B1 | 7/2001 | Skelton |
| 7,628,461 | B2 | 12/2009 | Carden et al. |
| 8,025,349 | B2 | 9/2011 | Lim et al. |
| 8,231,190 | B2 | 7/2012 | Ertz |
| 8,506,028 | B2 | 8/2013 | Lim |
| 9,157,641 | B1 | 10/2015 | Draper |
| 9,297,572 | B2 | 3/2016 | Bischoff |
| 10,443,286 | B1 | 10/2019 | Cocco |
| 10,478,040 | B1 | 11/2019 | Ford, Jr. |
| 2008/0223356 | A1 | 9/2008 | Shenouda |
| 2009/0151608 | A1 | 6/2009 | Aldred |
| 2010/0281911 | A1 | 11/2010 | Ha |
| 2011/0273070 | A1 | 11/2011 | Shin |
| 2012/0042670 | A1 | 2/2012 | Lee |
| 2012/0060544 | A1 | 3/2012 | Lee |
| 2012/0091874 | A1 | 4/2012 | Lee |
| 2013/0257238 | A1 | 10/2013 | Herron |
| 2016/0076289 | A1 | 3/2016 | Choi |
| 2017/0051542 | A1 | 2/2017 | Reske |
| 2017/0350638 | A1 | 12/2017 | Park |
| 2018/0132695 | A1 | 5/2018 | Lagness |
| 2018/0163443 | A1 | 6/2018 | Park |
| 2018/0283698 | A1 | 10/2018 | Lee |
| 2019/0024965 | A1 | 1/2019 | Park |
| 2020/0141627 | A1 | 5/2020 | Lambert |
| 2020/0340732 | A1 | 10/2020 | Querfurth |
| 2022/0081949 | A1* | 3/2022 | Scalf ..... E05B 7/00 |
| 2023/0184483 | A1 | 6/2023 | Jenkinson |
| 2023/0384015 | A1 | 11/2023 | Woodling et al. |

FOREIGN PATENT DOCUMENTS

| | | | | |
|---|---|---|---|---|
| CN | 102445045 | B | 9/2013 | |
| CN | 102359308 | B | 7/2016 | |
| CN | 107246184 | A | 10/2017 | |
| CN | 108020010 | A | 5/2018 | |
| CN | 109723279 | B | 9/2021 | |
| CN | 215632336 | U | 1/2022 | |
| CN | 216668084 | U | 6/2022 | |
| DE | 8416860 | U1 | 11/1984 | |
| DE | 10063353 | A1 | 6/2002 | |
| DE | 102007041301 | A1 * | 3/2009 | ..... A47L 15/4257 |
| DE | 102015116016 | A1 | 3/2016 | |
| DE | 102014223383 | A1 | 5/2016 | |
| DE | 102015104200 | A1 | 9/2016 | |
| EP | 0632180 | A1 | 1/1995 | |
| EP | 3021047 | A1 | 5/2016 | |
| GB | 190016241 | A | 4/1901 | |
| WO | 2004049865 | A1 | 6/2004 | |
| WO | 2009027405 | A1 | 3/2009 | |

OTHER PUBLICATIONS

Tran, Hanh Van, United States Patent and Trademark Office, Non-Final Office Action issued in U.S. Appl. No. 17/825,768, 102 pages, dated Oct. 18, 2023.

Neff, N 70 Built-in Oven, Retrieved from: https://www.neff-home.com/uk/productlist/ovens-compact-ovens/ovens/single-ovens/B57CR22N0B#/Tabs=section-manuals/Togglebox=accessories/Togglebox=manuals/Togglebox=accessoriesOthers/, Retrieved on Jun. 2, 2022.

Draper, Richard James, Oven Door Support Legs, Retrieved from https://forsalebyinventor.com/products/portfolio-item/oven-door-support-legs/, 2014.

Related Applications Transmittal dated Jan. 3, 2023.

Tran, Hanh Van, United States Patent and Trademark Office, Office Action issued in U.S. Appl. No. 17/825,768, 84 pages, dated Apr. 17, 2023.

Mah, Chuck Y., United States Patent and Trademark Office, Non-Final Office Action issued in U.S. Appl. No. 17/021,165, 134 pages, dated Jun. 16, 2023.

Mah, Chuck Y, United States Patent and Trademark Office, Notice of Allowance issued in U.S. Appl. No. 17/021,165, 20 pages, dated Nov. 3, 2023.

* cited by examiner

METHOD AND APPARATUS FOR ROTATING A POCKET RECESS OF A FREEZER DOOR

BACKGROUND

The present embodiments relate to a method and apparatus for articulating one or more portions of a pocket recess of a freezer door integrated into an appliance.

Typical appliance doors (e.g. dishwasher or refrigerator) may include an external handle that is stationary, projecting from the door, and add additional components to the appliance. Thus, there is a need to minimize the components of a door (e.g. freezer), support a freezer door when opened that may be subjected to one or more heavy loads of frozen goods/products via one or more baskets/racks, and/or create an easy open and/or recessed mechanism for freezer doors.

SUMMARY

In some embodiments of the invention, for example, an appliance having a freezer compartment may include a housing. Further, the housing may include the freezer compartment and may define an opening into the freezer compartment. In various embodiments, the appliance may include a freezer door hingedly attached adjacent the opening into the freezer compartment to the housing, and wherein the freezer door may be positionable between a closed position and an open position relative to the opening into the freezer compartment. In some embodiments, the freezer door may include a pocket recess, wherein the pocket recess is defined by a first portion, and wherein the first portion may be pivotably connected to a remaining portion of the freezer door.

In some embodiments, the freezer door may include a top wall and a front wall, wherein the pocket recess may intersect both the top wall and the front wall. In various embodiments, the freezer door may include a first side wall and an opposing second side wall, wherein the first portion of the pocket recess may include at least one of a portion of the front wall, a portion of the first side wall, and/or a portion of the second side wall. In various embodiments, the first portion of the pocket recess may include the portion of the front wall, the portion of the first side wall, and the portion of the second side wall. In some embodiments, the first portion of the pocket recess may actuate one or more feet between a stowed position and a deployed position. In various embodiments, the first portion of the pocket recess may include one or more feet. In various embodiments, the pocket recess may include a recessed front wall, an opposing recessed back wall, and a bottom wall interconnecting the recessed front wall and the recessed back wall, wherein the first portion may include the recessed front wall. In some embodiments, the first portion may include the recessed back wall and the bottom wall.

In various embodiments, a freezer door may be hingedly attached to an appliance and positionable between a closed position and an open position. In some embodiments, the freezer door may include a top wall, a front wall, and opposing side walls. In some embodiments, the freezer door may include a pocket recess intersecting both the top wall and the front wall, wherein the pocket recess may include a first portion pivotable connected to a remaining portion of the freezer door.

In addition, in some embodiments, the first portion of the pocket recess may include a portion of the front wall and a portion of both of the opposing side walls. In various embodiments, the first portion of the pocket recess may actuate one or more feet between a stowed position and a deployed position. In some embodiments, the first portion of the pocket recess may include one or more feet. In various embodiments, the pocket recess may include a recessed front wall, an opposing recessed back wall, and a bottom wall interconnecting the recessed front wall and the recessed back wall, wherein the first portion may include the recessed front wall. In some embodiments, the first portion may include the recessed back wall and the bottom wall. In various embodiments, the recessed back wall may be stationary with the remaining portion of the freezer door. In some embodiments, the first portion of the pocket recess may extend across a portion of the front wall between the opposing side walls. In some embodiments, the freezer door may be a bottom freezer door.

In various embodiments, a method of articulating a freezer door may include providing a housing having a freezer compartment defining an opening into the freezer compartment and a freezer door hingedly attached adjacent the opening into the freezer compartment to the housing, and wherein the freezer door may be positionable between a closed position and an open position relative to the opening into the freezer compartment, and wherein the freezer door may include a pocket recess pivotably connected to a remaining portion of the freezer door. In various embodiments, the method may include pivoting a portion of the pocket recess to position the freezer door to the open position relative to the opening into the freezer compartment.

In addition, in some embodiments, the portion of the pocket recess may include one or more feet. In various embodiments, the method may include deploying the one or more feet from a stowed position to a deployed position. In some embodiments, the method may include biasing the pivoting of the portion of the pocket recess and/or dampening the pivoting of the portion of the pocket recess. In various embodiments, the pocket recess may be recessed within both a top wall and a front wall of the freezer door.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
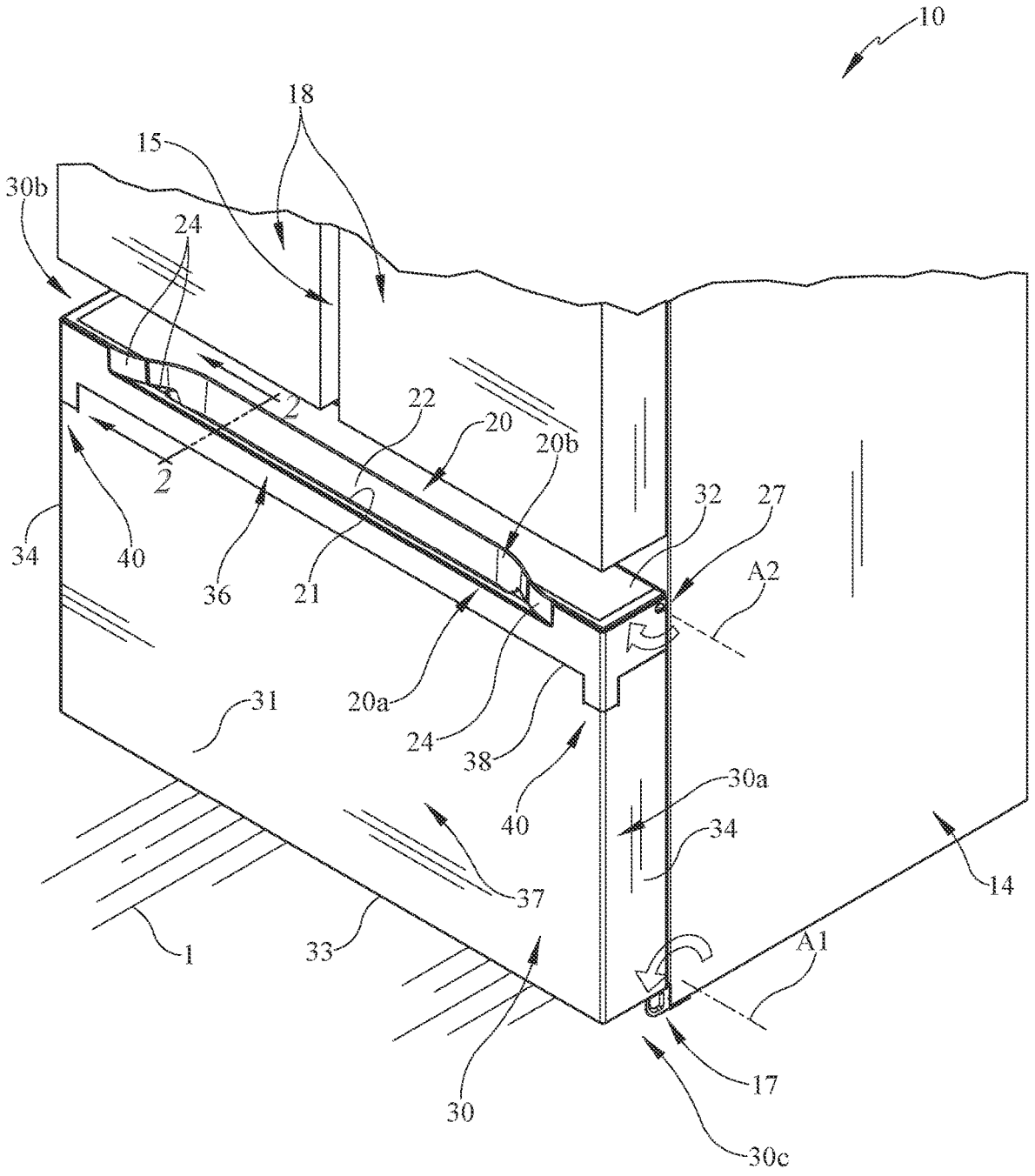
FIG. 1 is a perspective view of one embodiment of an appliance, with portions of the appliance broken away, having at least a freezer compartment/door illustrating an embodiment of a pocket recess positioned in a first pivot position and an embodiment of one or more feet in a stowed position.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential refrigerator appliance such as refrigerator appliance 10, such as the type that may be used in single-family or multi-family dwellings, or in other similar applications. However, it will be appreciated that the herein-described techniques and apparatuses may also be used in connection with other types of refrigerator/freezer appliances in some embodiments. For example, the herein-described techniques may be used in commercial applications in some embodiments. Moreover, the herein-described techniques may be used in connection with various refrigerator appliance configurations. Implementation of the herein-described techniques within refrigerators, freezers, bottom freezer refrigerators, compact refrigerators/freezers, chest freezers, standing freezers, side by side refrigerator, etc. using a freezer door (e.g. hinged) would be well within the abilities of one of ordinary skill in the art having the benefit of the instant disclosure, so the embodiments are not limited to the bottom freezer refrigerator implementation discussed further herein. In some embodiments, the appliance or device utilizing the method and apparatus for articulating at least a portion of a pocket recess may not be a refrigerator, or even a freezer.

Turning now to the drawings, the Figures illustrate an example refrigerator appliance 10 in which the various technologies and techniques described herein may be implemented. Refrigerator appliance 10 is depicted in this example as a French door bottom freezer refrigerator, and as such includes a front-mounted bottom freezer door 30 in a cabinet or housing 14 that provides access to the freezer compartment 13 housed within the cabinet or housing 14, and when in the open position (FIGS. 3, 4, 8, and 9), food and beverage items may be inserted into and removed from the freezer compartment 13 (e.g. freezer basket, bin, and/or rack 16). The housing 14 may define at least a portion of an opening 13*a* into the freezer compartment 13. Similarly, adjacent pivotable French doors 18 may provide access to the fresh-food compartment 15. Freezer door 30 is pivotably/hingedly attached to the housing 14 adjacent the freezer compartment 13 and/or opening 13*a*. The freezer door 30 may be a bottom freezer door as shown in the one embodiment. Freezer door 30 may be generally provided with a hinge 17 along a corresponding side or front edge of the housing 14 adjacent the freezer compartment 13 and is pivotable between a closed position (FIGS. 1 and 4) and an open position (FIGS. 2, 3, 5, and 6). The freezer door 30 or door body 30*a* may include a top edge 30*b* and an opposing bottom edge 30*c* adjacent the hinge 17 configured to engage the appliance 10. The freezer door 30 may be hinged or pivot about a horizontal axis (e.g. first axis A1). Although the door may be shown as pivoting about a horizontal axis, the door may pivot about an axis in a variety of orientations/positions. For example, the door 30 may hinge about a vertical axis and/or one or more opposing side walls 34 in some embodiments. The freezer door 30 or body 30*a* may include a front surface/wall 31 interconnecting the top edge 30*b*/ and/or top surface/wall 32 to the bottom edge 30*c* and/or bottom surface/wall 33. The freezer door 30 may include opposing side walls 34 interconnecting the top wall 32, front wall 31, and/or bottom wall 33. For example, the opposing side walls 34 may be a first side wall and a second side wall. When freezer door 30 is in the open position, food and beverage items may be inserted into and removed from the freezer compartment 13 through the bottom freezer door 30. Moreover, in some embodiments, when the freezer door 30 is in the open position, one or more freezer compartment bins, baskets, racks, or shelves 16 may be deployed from the freezer compartment 13 and onto the freezer door 30 to be supported by the door and/or the one or more feet or supports 40, if used.

As shown in the Figures, the appliance 10 and/or at least one freezer door 30 may include one or more pocket recesses 20, or portions thereof, (e.g. first portion/member) pivoting when opening/closing the freezer door 30. The pocket recess 20 may extend or be recessed into the body 30*a* of the door 30. The pocket recess 20 may intersect and/or be recessed within the top wall 32 and/or the front wall 31. Alternatively stated, the pocket recess 20, or portions thereof, may be defined or be included in the top edge 30*b* (e.g. front wall 31, side wall 34, and/or rear edge/periphery of the top wall 32) of the freezer door 30. In some embodiments, the pocket recess 20, or portions thereof, may include the entire top edge 30*b*. As shown in the one embodiment, the pocket recess 20 intersects and/or is recessed in both the top wall 32 and the front wall 31. The pocket recess 20, or portions thereof, may be spaced away from the door outer surfaces/ periphery or within the body 30*a* away from both the top wall 32 and the front wall 31 such that the pocket recess interrupts the outer periphery of the top wall 32 and/or front wall 31 of the door. The pocket recess 20, or portions thereof, (e.g. first portion 20*a*) is the object the user of the appliance 10 or freezer door 30 pulls on or pivots to open the door 30. The pocket recess 20 may be defined by at least a first portion/member 20*a* pivotably connected to the remaining portions of the pocket recess, if any, and/or freezer door. A first portion 20*a* of the pocket recess 20 may be recessed within the door body 30*a* and may be pivoted or pulled by the user to open (e.g. pivot) the door (e.g. freezer). The first portion 20*a* of the pocket recess 20 may include one or more walls of the pocket recess. The first portion 20*a* or one or more portions of the pocket recess 20 may be pivoted alone or in combination with one or more walls/surfaces/portions/ outer peripheries 36 of the freezer door 30 (e.g. front wall, top wall, a first side wall, a second side wall, and/or bottom wall). The first portion 20*a* may be pivoted or deployed from a first pivot position (FIGS. 1, 2, 6, 7) to a second pivot position (FIGS. 3-5 and 8-10) different from the first pivot position relative to another or second portion/member 20*b* of the pocket recess and/or remaining portion 37 of the freezer door. The remaining portion 37 of the freezer door 30 may include a portion/member (e.g. second portion 20*b*) of the pocket recess 20 in some embodiments. The first portion 20*a* may be pivotably connected to the remaining portion 37 of the freezer door 30 and/or second portion 20*b*, if any, of the pocket recess. The first portion 20*a* of the pocket recess 20 may be stowed within a receptacle or cavity 25 of the pocket recess 20 (e.g. second portion 20*b*) and subsequently pivoted/deployed out of the pocket recess (e.g. receptacle 25). The pocket recess 20 (e.g. first portion/member, second portion/member, etc.) may include at least one recessed front wall 21, at least one opposing recessed back wall 22, at least one bottom wall 23, and/or at least one side wall(s) 24. The bottom wall 23 and/or side wall 24 may interconnect the recessed front wall 21 to the recessed back wall 22. One or more recessed side walls 24 (e.g. opposing) may interconnect the bottom wall 23, front wall 21, and/or back wall 22. The recessed front wall 21 and/or back wall 22 may be substantially parallel to and/or spaced inwardly from the front wall 31 of the door 30. The recessed bottom wall 23 may be substantially parallel to and/or spaced inwardly from the top wall 32 of the door 30. The one or more side walls 24 may be substantially parallel to and/or spaced inwardly from the freezer door side walls 34 in some embodiments. It should be understood that the pocket recess may be a variety of shapes, sizes, quantities, constructions, and in a variety of positions relative to the door and still be within the scope of the invention.

Figure 2:
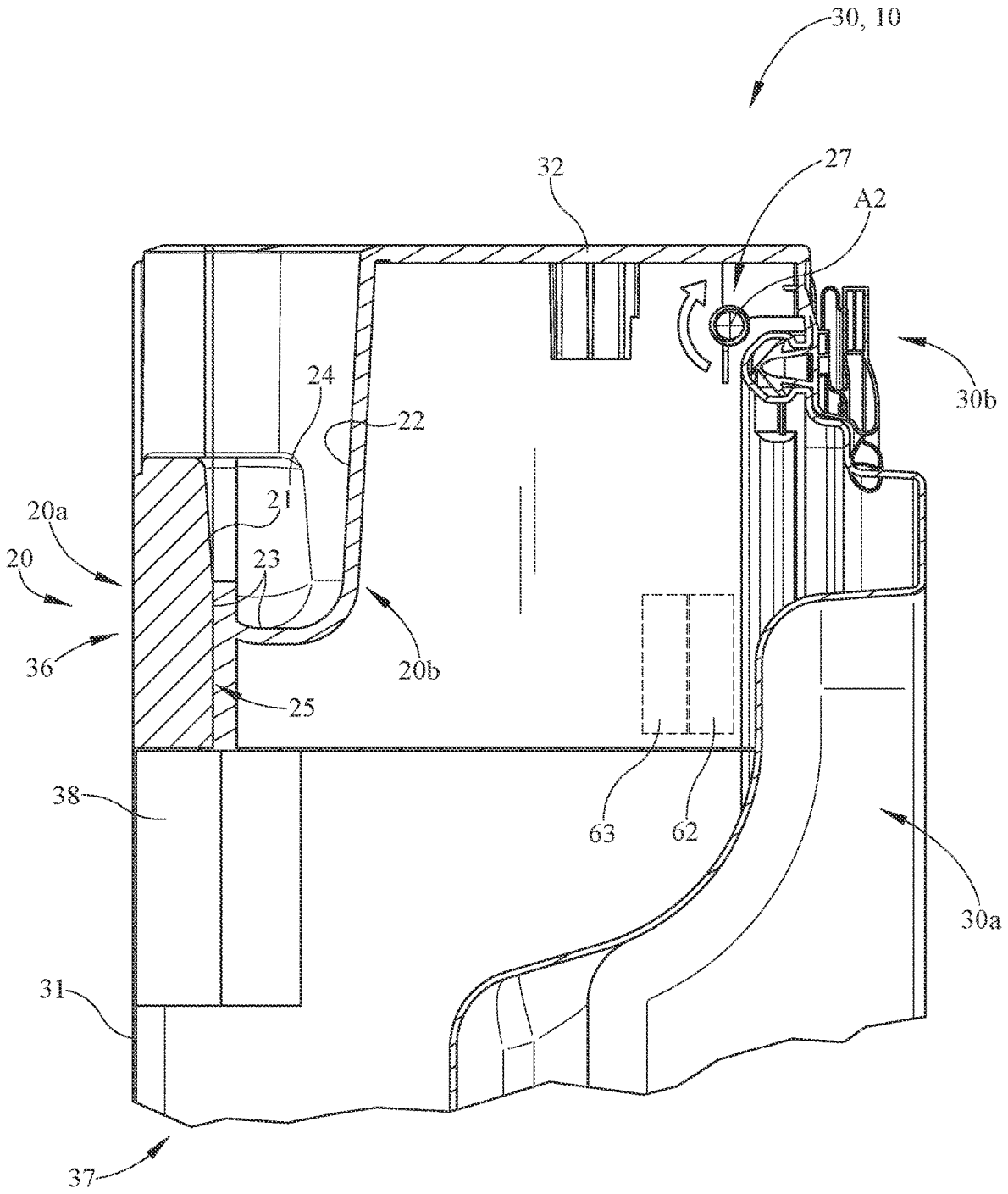
FIG. 2 is a sectional view taken along line 2-2 of FIG. 1.
Figure 3:
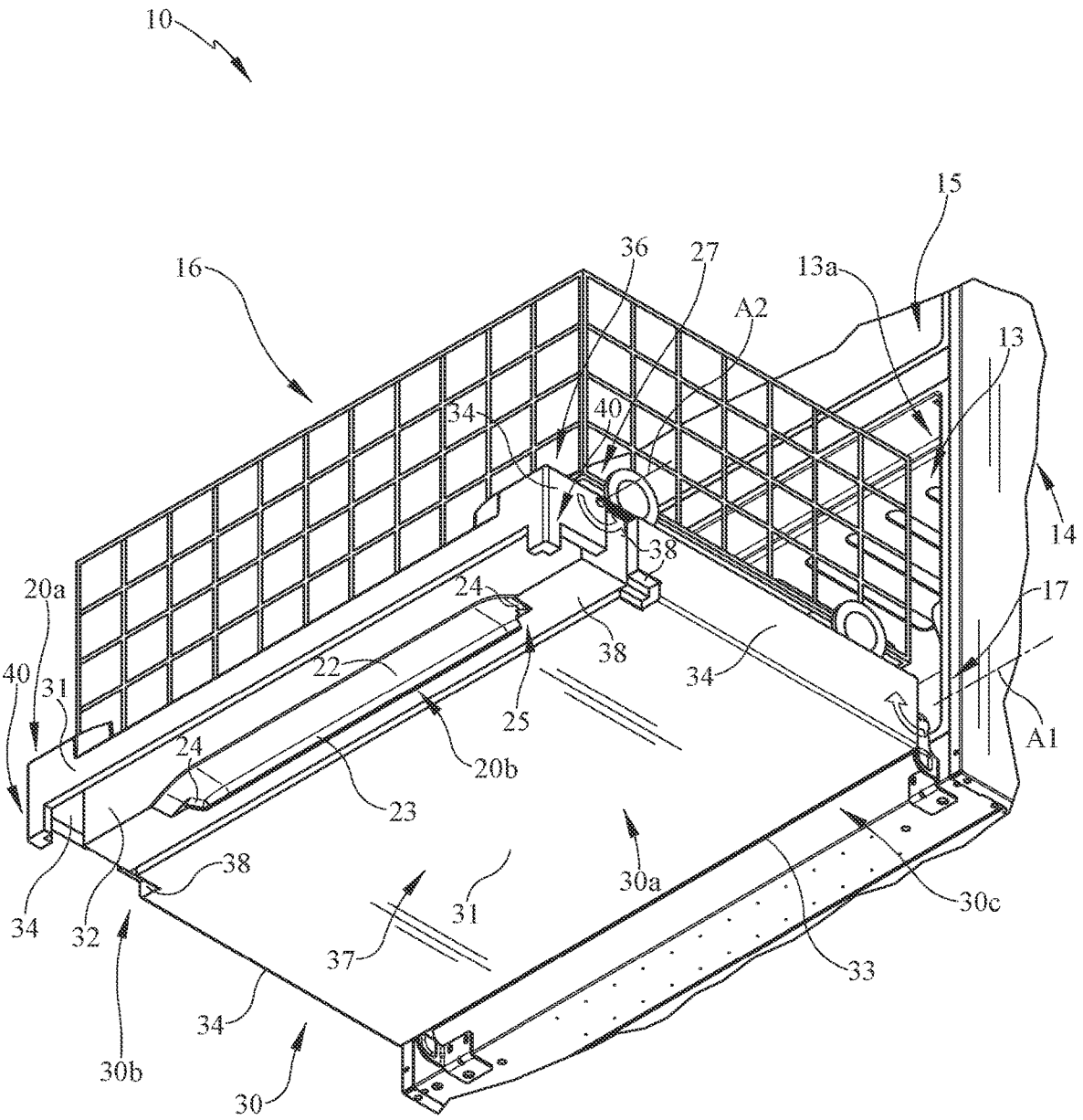
FIG. 3 is a perspective view of one embodiment of an appliance, with portions of the appliance broken away, having at least a freezer compartment/door illustrating a portion of the pocket recess and the freezer door pivoted to a second pivot position and one or more feet in a deployed position.
Figure 4:
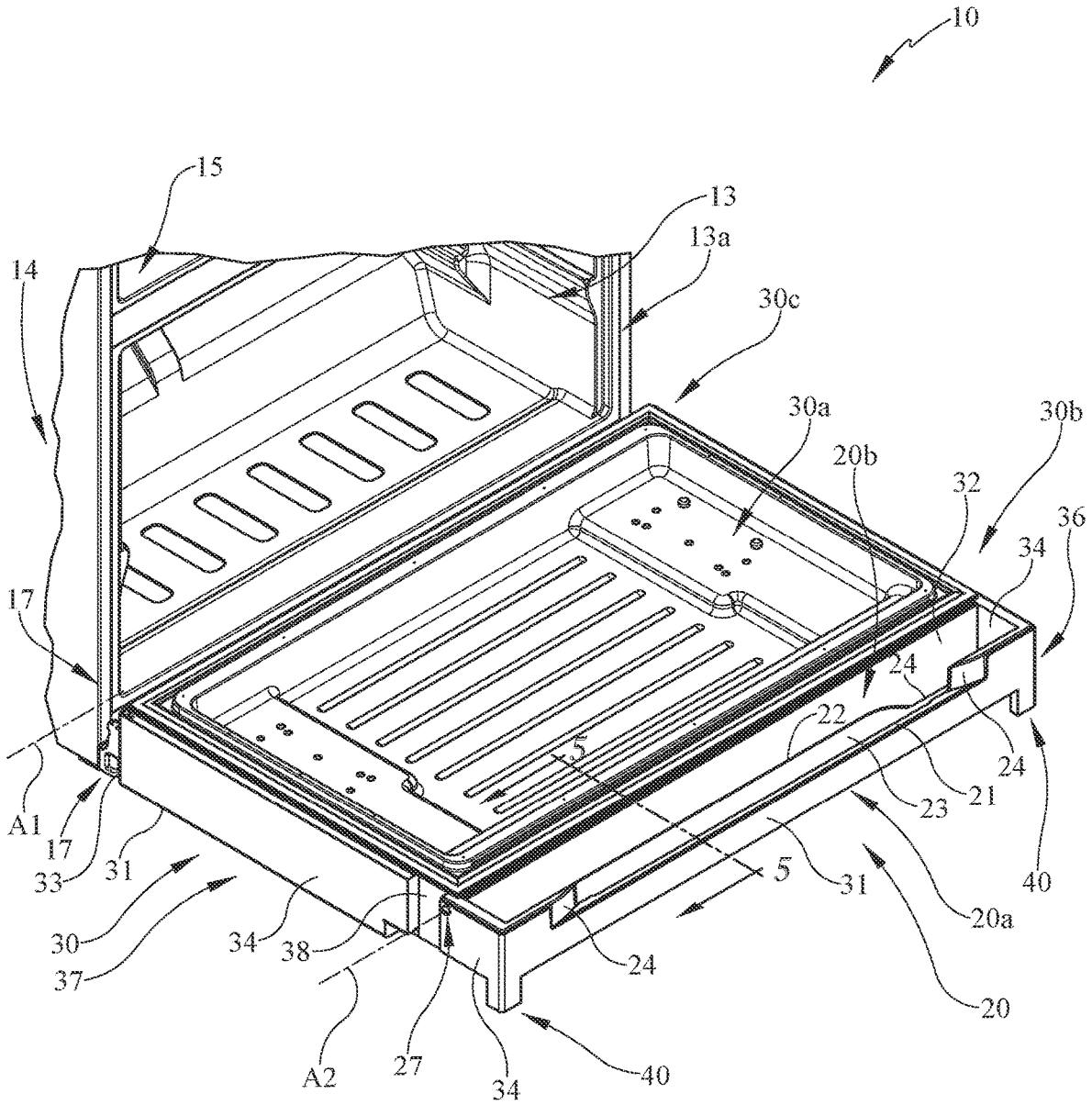
FIG. 4 is another perspective view of FIG. 3.
Figure 5:
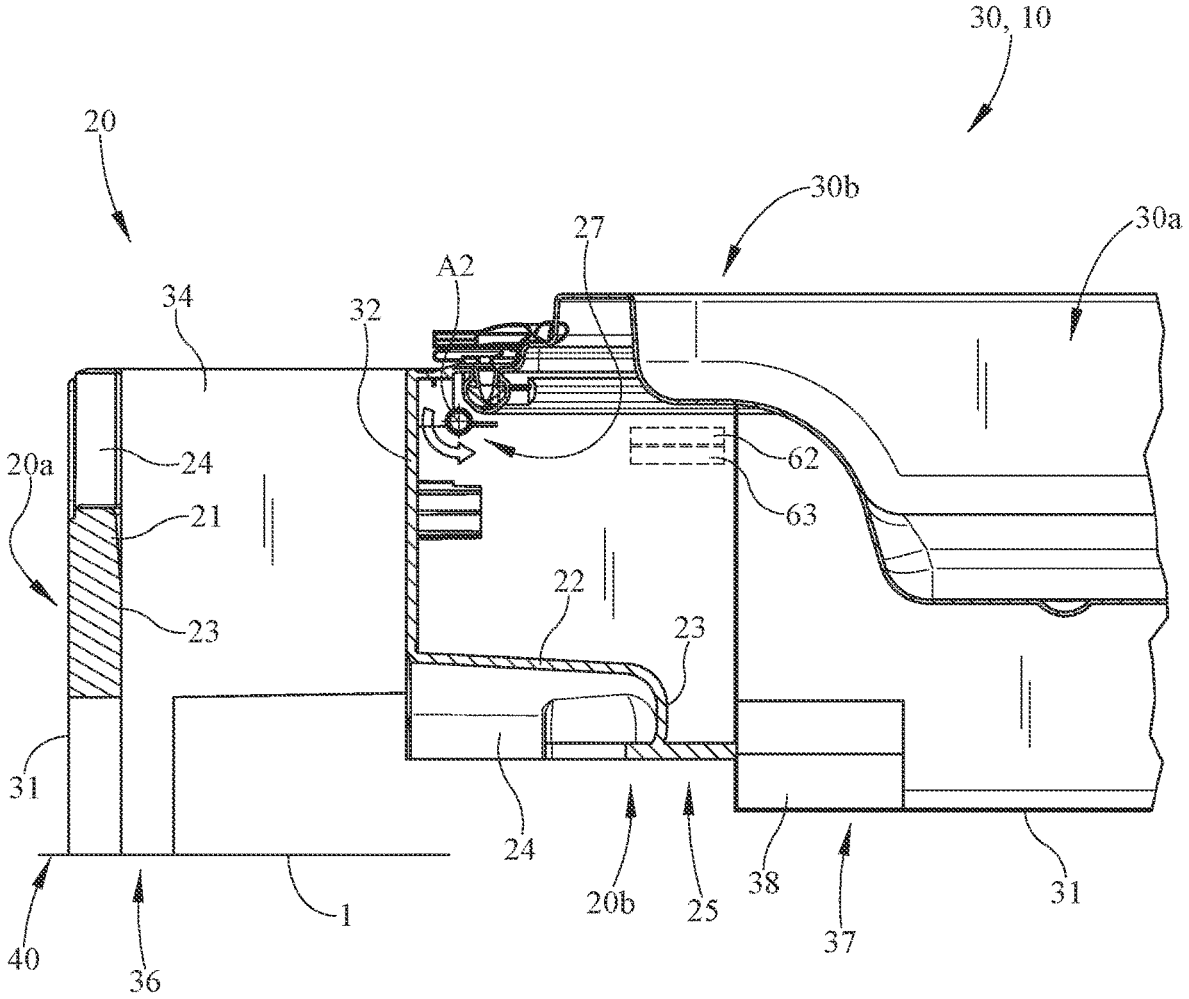
FIG. 5 is a sectional view taken along line 5-5 of FIG. 4.
Figure 6:
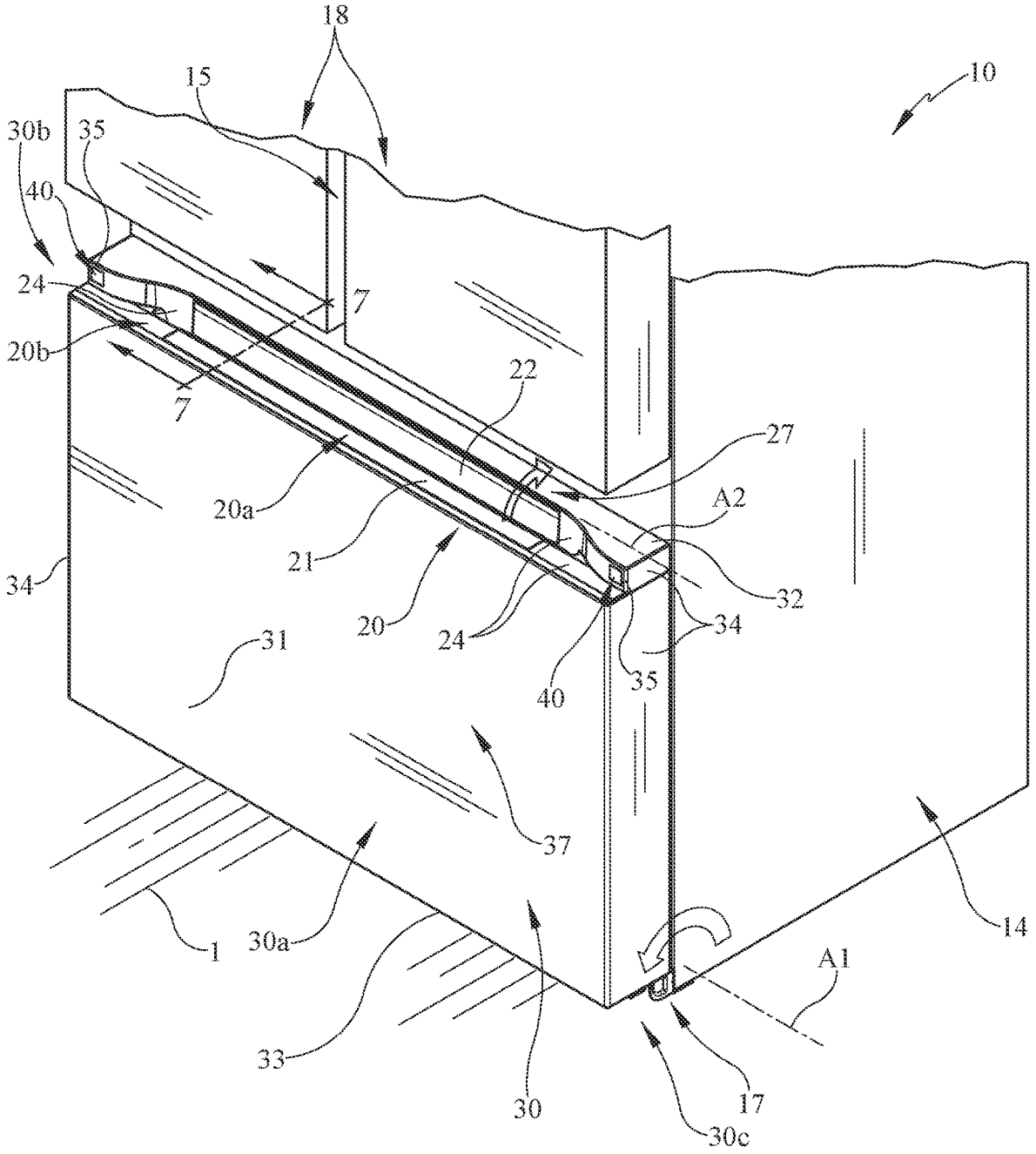
FIG. 6 is a perspective view of one embodiment of an appliance, with portions of the appliance broken away, having at least a freezer compartment/door illustrating another embodiment of a pocket recess positioned in a first pivot position and an embodiment of one or more feet in a stowed position.
Figure 7:
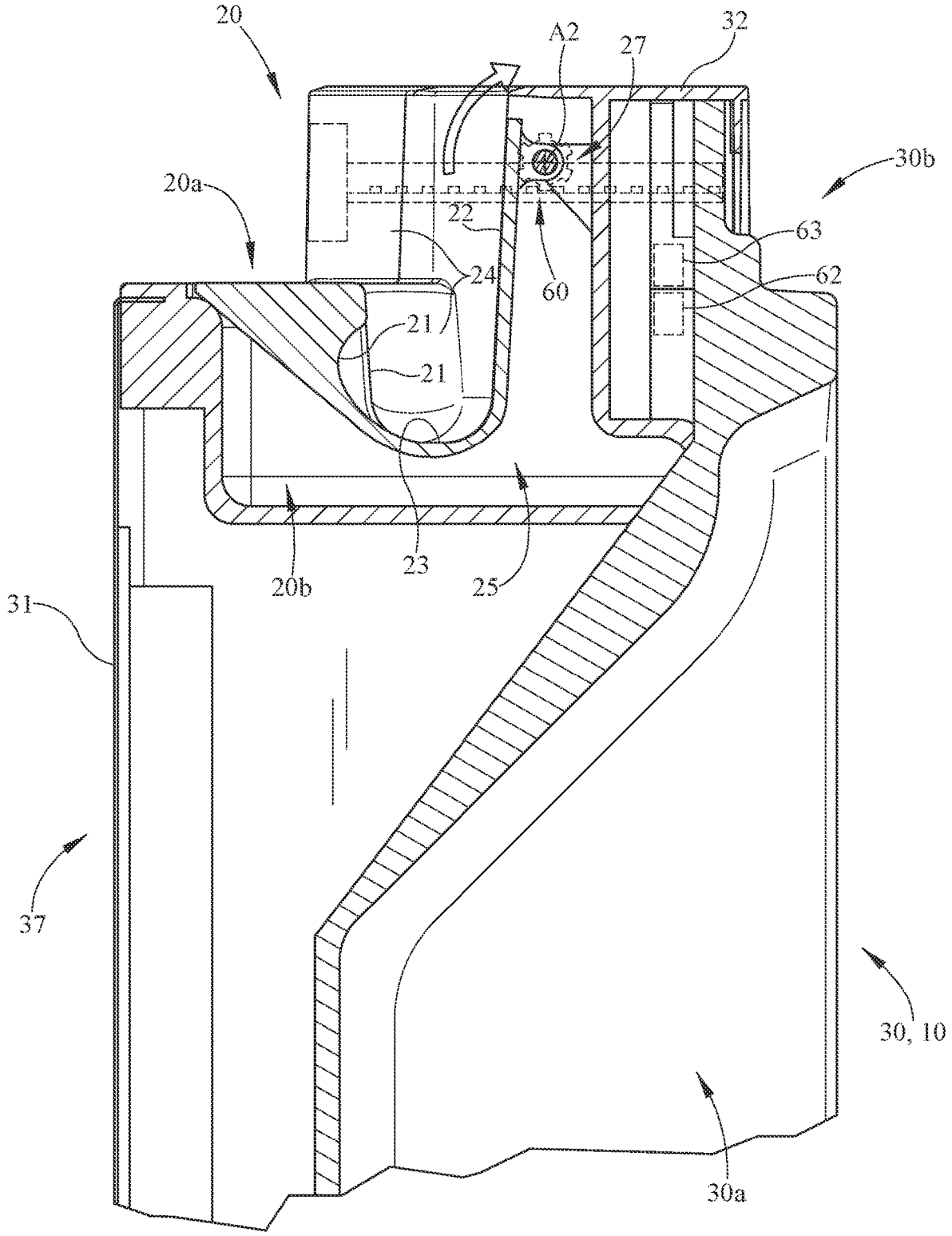
FIG. 7 is a sectional view taken along line 7-7 of FIG. 6.
Figure 8:
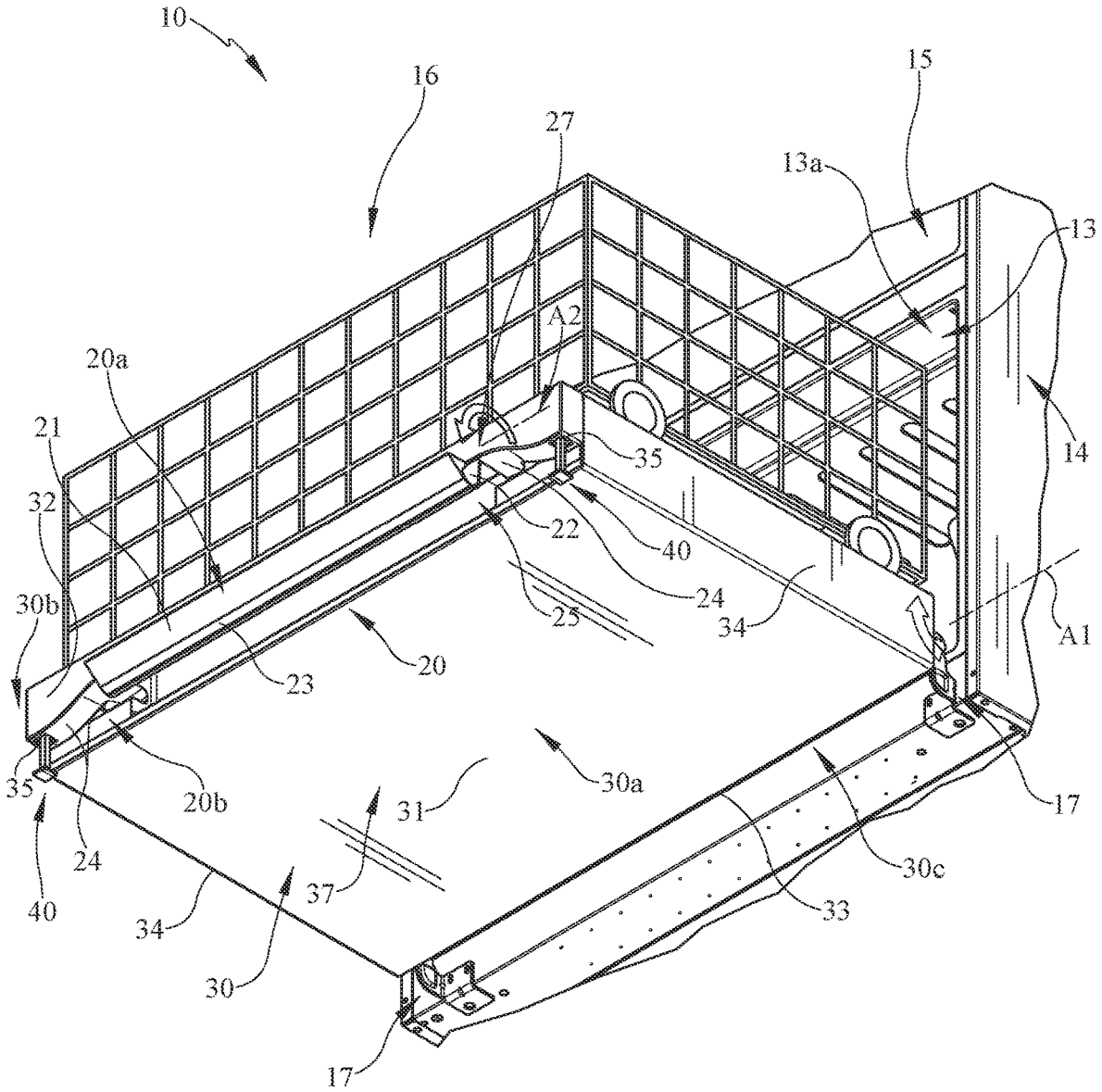
FIG. 8 is a perspective view of one embodiment of an appliance, with portions of the appliance broken away, having at least a freezer compartment/door illustrating a portion of the pocket recess and the freezer door pivoted to a second pivot position and one or more feet in a deployed position.
Figure 9:
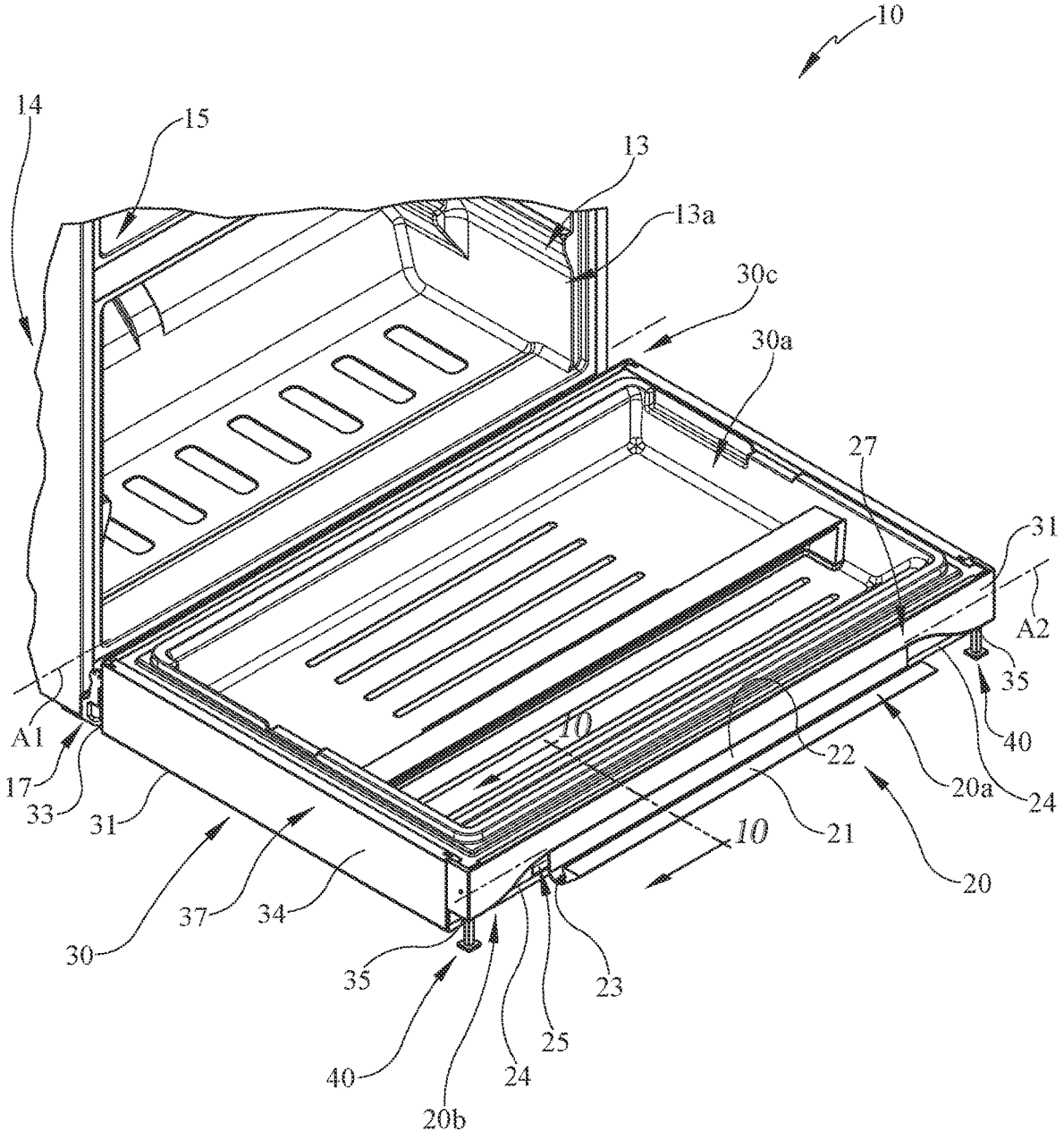
FIG. 9 is another perspective view of FIG. 8.
Figure 10:
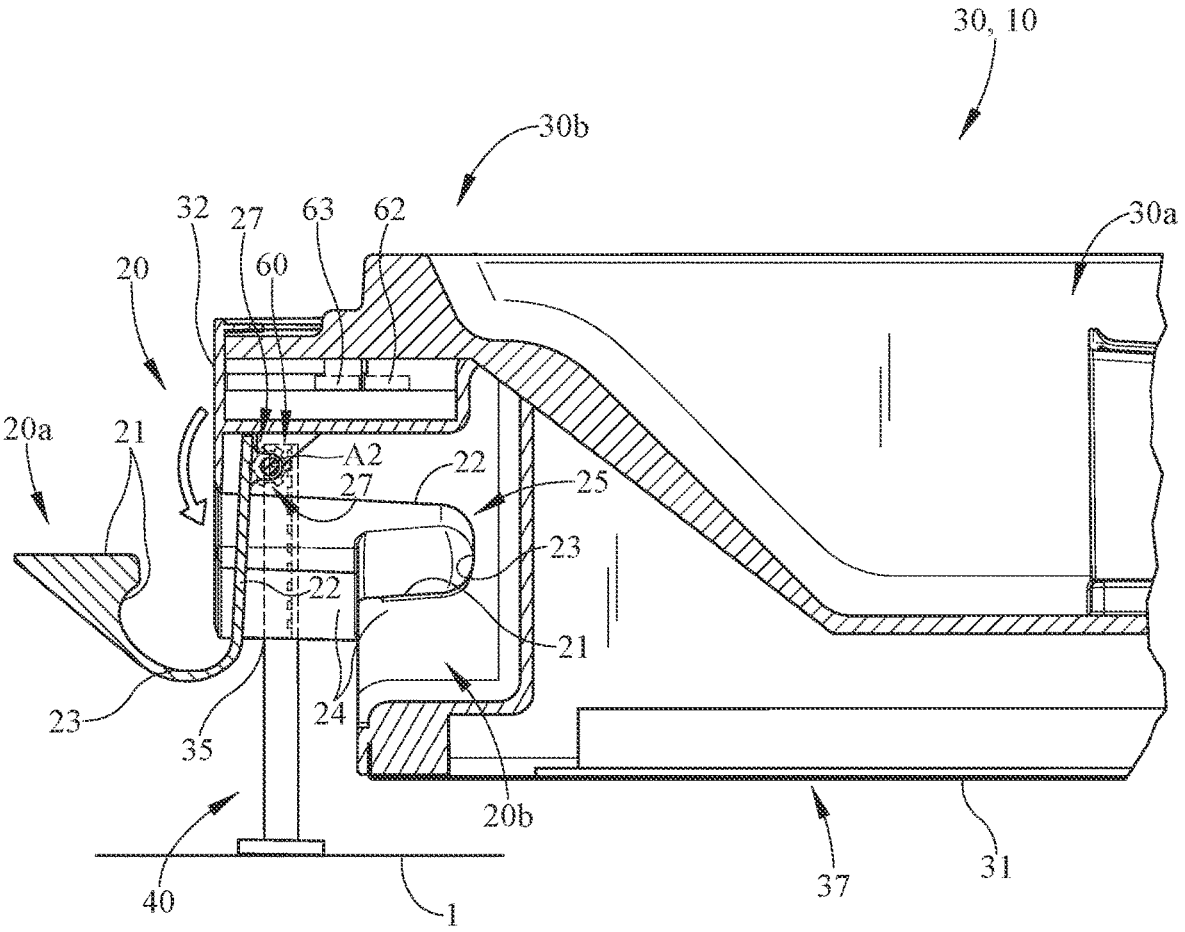
FIG. 10 is a sectional view taken along line 10-10 of FIG. 9.

In some implementations, the pocket recess 20, or portions thereof, may be pivotably connected to one or more remaining portions (e.g. 37, 20*b*) of the freezer door 30 and/or pocket recess 20. As shown in FIGS. 1-10, the first portion 20*a* of the pocket recess 20 is pivotably connected to the remaining portion (e.g. 37, 20*b*) of the freezer door 30 and/or pocket recess 20*b*. The first portion 20*a* of the pocket recess 20 may extend for a variety of lengths between and/or across a portion of the top edge 30*b* and/or front wall 31 of the freezer door 30 between the opposing side walls 34. In some embodiments, the first portion 20*a* of the pocket recess 20 may include the recessed front wall 21, back wall 22, bottom wall 23, and/or one or more side walls 24. In some embodiments, the first portion 20*a* may include the recessed front wall 21. In some embodiments, the first portion 20*a* may include the recessed front wall 21 and bottom wall 23. In some embodiments, the first portion 20*a* may include the recessed front wall 21 and back wall 22. In some embodiments, the first portion 20*a* may include the recessed front wall 21, bottom wall 23, and back wall 22. In some embodiments, the first portion 20*a* may include the recessed front wall 21, bottom wall 23, one or more side walls 24, and back wall 22. As shown in FIGS. 1-3, the first portion 20*a* may include at least a portion of the front wall 21, side wall 24, and the bottom wall 23 pivoting relative to the remaining portion (e.g. 37, 20*b*) of the freezer door/pocket recess (e.g. at least a portion of the stationary recessed back wall 22, side wall 24, bottom wall 23, and/or second portion 20*b* of the recess). As shown in FIGS. 4-6, the first portion 20*a* may include the front wall 21, bottom wall 23, and the back wall 22 pivoting relative to the remaining portion (e.g. 37, 20*b*) of the freezer door/pocket recess (e.g. at least a portion of the recessed side walls 24, back wall 22, front wall 21, and/or second portion 20*b* of the recess).

In some implementations, the pivoting first portion 20*a* may only include portions of the pocket recess 20. As shown in the one embodiment in FIGS. 6-10, the pivoting first portion 20*a* may only include the pocket recess (e.g. one or more portions of or all of the pocket recess) pivoting or moving between the first pivot position and the second pivot position.

In some implementations, the pivoting portion of the pocket recess 20 may include a portion 20*a* of the pocket recess and a portion 36 of the freezer door pivoting or moving between the first pivot position and the second pivot position. In the one embodiment shown in FIGS. 1-5, the first portion 20*a* of the pocket recess 20 may include a portion 36 of the freezer door 30 pivoting or moving between the first pivot position and the second pivot position relative to the remaining portion of the freezer door (e.g. 37 and/or 20*b*). The freezer door portion 36 pivoting with the first portion 20*a* of the pocket recess 20 may be adjacent to or surround a portion of the pocket recess. The first portion 20*a* of the pocket recess 20 may include a portion of the front wall 31, a portion of one or more side walls 34 (e.g. first side wall, second side wall), and/or top wall 32 of the freezer door 30 (e.g. outer periphery). As shown in FIGS. 1-5, the first portion 20*a* includes a portion of the front wall 31 and opposing side walls 34 (e.g. first and second) of the freezer door. As shown in the one embodiment, the pivoting portion 36 of the freezer door 30 may wrap around the top edge 30*b* of the freezer door and/or be positioned below the pocket recess 20 when in the first position. The pivoting portion 36 of the door 30 may extend downwardly from the top wall 32 and/or pocket recess 20. In the second pivot position as shown in FIGS. 3-5, the pivoting portion 36 of the door may extend upwardly or project from the top wall 32 and define a through opening. In some embodiments, the one or more pivoting portions 36 of the freezer door 30 (e.g. front wall, opposing side walls) pivoting with the pocket recess 20 (e.g. first portion) may sit or be positioned flush with the remaining portions 37 of the freezer door 30 when in the first pivot position. The pivoting portion 36 of the freezer door 30 may sit or be stowed within a receptacle, recess, or groove 38 within the remaining portion 37 when in the first pivot position to maintain a flush appearance. It should be understood that a portion of the pivoting freezer door portion, if used, may sit slightly recessed or sub-flush from the remaining outer periphery of the freezer door in some embodiments. In other embodiments, a portion of the pivoting freezer door portion, if used, may protrude from or slightly project from the remaining outer periphery of the freezer door.

In some implementations, the pocket recess, or portions thereof, may be described as not having or defining a through gap or through opening therein (e.g. when at least in the first pivot or closed position). In some embodiments, the pocket recess 20, or portions thereof, may not be flush with or project outwardly away from the outer periphery or surfaces of the freezer door in the first pivot/closed position.

In some implementations, the pocket recess and/or freezer door, if used, or portions thereof, may pivot about a hinge 27 or axis A2 (e.g. second). The second axis A2 of the of the pivoting/first portion 20*a*, 36 (e.g. recess, freezer door) may be a horizontal axis. The second axis A2 may be spaced away from the front wall 31 of the freezer door (e.g. adjacent the back wall of the freezer door). The second axis A2 may be positioned adjacent the top edge 30*b*. The pocket recess 20 (e.g. 20*a*, 36) may pivot about the second axis A2 or hinge 27 within the pocket recess as shown in FIGS. 6-10 or may pivot outside the pocket recess 20 about the second axis A2 or hinge 27 as shown in FIGS. 1-5. Although the second axis A2 is parallel with the first axis A1 of the pivoting freezer door 30, the first and second axis A1, A2 may not be parallel to each other in some embodiments. Moreover, the first/pivoting portion 20*a*, 36 (e.g. pocket recess, freezer door) may pivot about the second axis A2 in a first direction (e.g. CW, CCW) and the freezer door 30 may pivot about the first axis A1 in a second direction opposite to the first direction as shown in the one embodiment. Alternatively, the pivoting about each axis A1, A2 may occur in the same direction (e.g. CW, CCW).

In some implementations, the pocket recess 20, or portions thereof, may include one or more feet 40. The pocket recess 20 may include one or more feet 40 pivoting between the first pivot position and the second pivot position. As shown in the one embodiment in FIGS. 1-5, the first portion 20*a* of the pocket recess 20 may include one or more feet 40. The pivoting portion 36 of the freezer door 30 may include the one or more feet 40. The one or more feet 40 of the pivoting portion 36 of the freezer door 30, pivoting with the pocket recess 20, may include or be defined as a portion of the front wall 31 and/or one or more side walls 34. The one or more feet 40 may include the corner between the front wall 31 and the side wall(s) 34 of the freezer door. As shown in the one embodiment in FIGS. 1-5, at least one foot 40 is defined by both the side wall 34 and the front wall 31, adjacent the top edge 30*b* and/or opposing side walls 34. In some embodiments, the first portion 20*a* of the pocket recess may include one or more pivoting feet.

In some implementations, the pocket recess, or portion thereof, (e.g. first portion) may actuate (e.g. deploy, stow) one or more feet between a stowed position and a deployed position. The at least one freezer door 30 and/or pocket recess 20 (e.g. first portion, second portion) may include one or more feet 40, if used, to support the freezer door 30 and/or freezer rack 16 to the ground/floor 1 when the freezer door 30 is in the open position. The one or more feet 40 (e.g. posts, legs, etc.), or portions thereof, may be positionable between at least one stowed position within the door 30 (e.g. front surface 31, top edge 30*b*, cavity 35) and one or more deployed positions different from the stowed position or extending out or outwardly away from the freezer door 30 (e.g. front surface 31, top edge 30*b*, cavity 35). The one or more feet 40 may be deployed from one or more compartments/cavities 35 within the freezer door 30 and/or pocket recess 20. The one or more cavities 35 may be positioned in the front surface 31, top surface 32, pocket recess 20, and/or top edge 30*b* of the freezer door 30. As shown in the one embodiment, the one or more cavities 35 and feet 40 are positioned in the pocket recess 20 (e.g. second portion 20*b*, back wall 22, side wall 24). The pocket recess, or portions thereof, may be used to position/actuate (e.g. pivot, move, drive) the door 30 between the closed position and the open position. As shown in the one embodiment in FIGS. 6-10, the pocket recess 20 may be used to actuate or drive the one or more feet 40 between the stowed position and the deployed position (e.g. from the stowed position to the deployed position and/or from the deployed position to the stowed position). The pocket recess 20, or portions thereof, may pivot between one or more positions (e.g. first pivot position, second pivot position, etc.) when actuating the one or more feet 40 and/or articulating assembly. As shown in FIGS. 6-10, when the freezer door 30 is in the open position and the one or more feet, or portions thereof, are in the deployed position, the pocket recess 20 may be in a second pivot position extending/projecting from the pocket recess 20 and/or freezer door 30 (e.g. 90 degrees from the first pivot position, substantially perpendicular to the top surface 32, horizontal to the ground 1). In some implementations, one or more articulating assemblies 60 may be used between the one or more feet 40 and the appliance 10, or portions thereof (e.g. freezer door 30, pocket recess 20, first portion 20*a*) to deploy and/or stow the one or more feet/supports 40. The articulating assembly 60 may be one or more rack and pinion engagements. The articulating assembly and/or rack and pinion engagement may allow or convert the motion (e.g. rotatory and/or pivoting) of the pocket recess and/or portions of the freezer door into motion (e.g. linear) of the one or more feet 40 to deploy/stow relative to the remaining portion of the appliance 10 (e.g. freezer door 30). It should be understood that the articulating assembly, or portions thereof, may be a variety of shapes, sizes, quantities, constructions, and positions within the appliance/freezer door and still be within the scope of the invention herein. For example, the rack and pinion may disengage from each other during relative movement between each other in some embodiments. Further, for example, the articulating assembly, pocket recess, appliance, feet, and/or freezer door may include one or more biasing elements 63 (e.g. torsion spring) to return the pocket recess to the first position and/or feet to the stowed position. The biasing element 63, if used, may be positioned between the pair of racks and/or pinions (e.g. spaces or channels between one or more pairs). Moreover, for example, one or more rotatory dampers 62 may be used to slow the biasing element and/or return of the pocket recess to a position and/or foot to the stowed position. The damper(s) 62, if used, may be positioned between the pair of racks and/or pinions (e.g. spaces or channels between one or more pairs). The articulating assembly, in some embodiments, may include one or more pulleys and/or cam followers.

In use, when the freezer door 30 is in the closed position the freezer compartment 13 may be sealed, the one or more freezer racks 16 may be stowed, the one or more feet 40, if used, may be in the stowed position, and/or the pocket recess 20 (e.g. 36, 20*a*) may be in the first position (e.g. first pivot position). The user may use the pocket recess 20, or portions thereof, to assist in opening the freezer door 30. The freezer door 30 may be pivoted about the hinge 17 to the open position. One or more portions of the pocket recess 20 and/or freezer door 30 may be pivoted about the hinge 27 to the open position. Upon actuating (e.g. rotating/pivoting) the pocket recess 20, or portions thereof, from the first position (e.g. pivot) to the second position (e.g. pivot), the one or more feet 40, if used, are carried therewith (See FIGS. 1-5) or move/deploy (FIGS. 6-10) from the stowed position to the deployed position. The pocket recess, articulating assembly, rack and pinion engagement, or portions thereof may be actuated to stow/deploy the one or more feet 40, or portions thereof relative to the appliance/freezer door. When in the deployed position, the one or more feet 40, if used, may support the freezer door 30 (e.g. horizontal position) against the ground/floor 1. The user may then deploy the one or more freezer racks 16 (e.g. baskets) from the freezer compartment 13 and onto the freezer door 30 (e.g. interior or back side) in its open position. The freezer door 30 and/or one or more feet 40, if used, may support one or more forces applied to the door and/or the weight of the one or more freezer racks/bins/baskets 16 and its contents. Upon placement of the one or more freezer racks 16 to the stowed position within the freezer compartment 13, the freezer door 30 may be closed by the user. Upon actuating (e.g. rotating/pivoting) the pocket recess, or portions thereof, and/or portions of the freezer door from the second position (e.g.

pivot) to the first position (e.g. pivot), the one or more feet 40, if used, are carried therewith or move/stow from the deployed position to the stowed position. The biasing element and/or damper, if used, may return or assist the user in stowing the one or more feet and/or pocket recess, or portions thereof.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An appliance having a freezer compartment comprising:

a housing having the freezer compartment and defining an opening into the freezer compartment;

a freezer door hingedly attached adjacent the opening into the freezer compartment to the housing, and wherein the freezer door is positionable between a closed position and an open position relative to the opening into the freezer compartment; and wherein the freezer door includes a pocket recess, wherein the pocket recess is defined by a first portion, wherein the first portion is pivotably connected to a remaining portion of the freezer door.

2. The appliance of claim 1 wherein the freezer door includes a top wall and a front wall, wherein the pocket recess intersects both the top wall and the front wall.

3. The appliance of claim 2 wherein the freezer door includes a first side wall and an opposing second side wall, wherein the first portion of the pocket recess includes at least one of a portion of the front wall, a portion of the first side wall, and/or a portion of the second side wall.

4. The appliance of claim 3 wherein the first portion of the pocket recess includes the portion of the front wall, the portion of the first side wall, and the portion of the second side wall.

5. The appliance of claim 1 wherein the first portion of the pocket recess actuates one or more feet between a stowed position and a deployed position.

6. The appliance of claim 1 wherein the first portion of the pocket recess includes one or more feet.

7. The appliance of claim 1 wherein the pocket recess includes a recessed front wall, an opposing recessed back wall, and a bottom wall interconnecting the recessed front wall and the recessed back wall, wherein the first portion includes the recessed front wall.

8. The appliance of claim 7 wherein the first portion includes the recessed back wall and the bottom wall.

9. A freezer door hingedly attached to an appliance and positionable between a closed position and an open position, the freezer door comprising:

a top wall, a front wall, and opposing side walls; and a pocket recess intersecting both the top wall and the front wall, wherein the pocket recess includes a first portion pivotable connected to a remaining portion of the freezer door.

10. The freezer door of claim 9 wherein the first portion of the pocket recess includes a portion of the front wall and a portion of both of the opposing side walls.

11. The freezer door of claim 9 wherein the first portion of the pocket recess actuates one or more feet between a stowed position and a deployed position.

12. The freezer door of claim 9 wherein the first portion of the pocket recess includes one or more feet.

13. The freezer door of claim 9 wherein the pocket recess includes a recessed front wall, an opposing recessed back wall, and a bottom wall interconnecting the recessed front wall and the recessed back wall, wherein the first portion includes the recessed front wall.

14. The freezer door of claim 13 wherein the first portion includes the recessed back wall and the bottom wall.

15. The freezer door of claim 13 wherein the recessed back wall is stationary with the remaining portion of the freezer door.

16. The freezer door of claim 9 wherein the first portion of the pocket recess extends across a portion of the front wall between the opposing side walls.

17. The freezer door of claim 9 is a bottom freezer door.

18. A method of articulating a freezer door comprising the steps of:

providing a housing having a freezer compartment defining an opening into the freezer compartment and a freezer door hingedly attached adjacent the opening into the freezer compartment to the housing, and wherein the freezer door is positionable between a closed position and an open position relative to the opening into the freezer compartment, and wherein the freezer door includes a pocket recess pivotably connected to a remaining portion of the freezer door; and pivoting a portion of the pocket recess to position the freezer door to the open position relative to the opening into the freezer compartment.

19. The method of claim 18 wherein the portion of the pocket recess includes one or more feet, and deploying the one or more feet from a stowed position to a deployed position.

20. The method of claim 18 further comprising biasing the pivoting of the portion of the pocket recess and/or dampening the pivoting of the portion of the pocket recess.

21. The method of claim 18 wherein the pocket recess is recessed within both a top wall and a front wall of the freezer door.

* * * * *